US008283993B2

(12) United States Patent
Coleman

(10) Patent No.: US 8,283,993 B2
(45) Date of Patent: Oct. 9, 2012

(54) BROADBAND TWIST CAPSULES

(75) Inventor: Donnie S. Coleman, Dublin, VA (US)

(73) Assignee: Moog Inc., East Aurora, NY (US)

( * ) Notice: Subject to any disclaimer, the term of this patent is extended or adjusted under 35 U.S.C. 154(b) by 20 days.

(21) Appl. No.: 12/449,757

(22) PCT Filed: Sep. 18, 2008

(86) PCT No.: PCT/US2008/010845

§ 371 (c)(1),
(2), (4) Date: Aug. 25, 2009

(87) PCT Pub. No.: WO2010/019127

PCT Pub. Date: Feb. 18, 2010

(65) Prior Publication Data

US 2011/0183530 A1 Jul. 28, 2011

(51) Int. Cl.
*H01R 39/00* (2006.01)
*H01B 3/00* (2006.01)

(52) U.S. Cl. ..... 333/32; 439/11; 174/110 R

(58) Field of Classification Search ..... 333/32; 439/11, 21; 174/110 R
See application file for complete search history.

(56) References Cited

U.S. PATENT DOCUMENTS

| | | | | |
|---|---|---|---|---|
| 4,693,527 | A * | 9/1987 | Bonenberger | 439/13 |
| 4,710,131 | A * | 12/1987 | Bonenberger | 439/13 |
| 5,008,903 | A * | 4/1991 | Betts et al. | 375/221 |
| 6,296,725 | B1 * | 10/2001 | Lawson et al. | 156/50 |
| 7,099,404 | B2 * | 8/2006 | Dally | 375/296 |
| 7,602,134 | B1 * | 10/2009 | Taylor et al. | 318/648 |
| 7,693,691 | B1 * | 4/2010 | Tao et al. | 703/2 |
| 2008/0260049 | A1 * | 10/2008 | Wood | 375/257 |

* cited by examiner

*Primary Examiner* — Dean O Takaoka
*Assistant Examiner* — Alan Wong
(74) *Attorney, Agent, or Firm* — Phillips Lytle LLP

(57) ABSTRACT

A twist capsule (10) broadly includes: a flexible tape (13), and a pre-emphasis circuit (11) operatively associated with said tape to compensate for attenuation of high-frequency digital waveform constituents attributable to skin effect and/or dielectric loss, such that the operational bandwidth of signal transmitted over said tape may be increased. An equalization circuit (14) may be arranged at the output end of the tape to further extend the operational bandwidth.

10 Claims, 2 Drawing Sheets

BROADBAND TWIST CAPSULES

TECHNICAL FIELD

The present invention relates generally to twist capsules, and, more particularly, to improved broadband twist capsules with extended high-frequency response and signal conditioning, by use of a pre-emphasis circuit, and, optionally, an equalization circuit, that extend the high-speed data signaling capabilities to beyond 10.0 gigabits per second ("Gbps").

BACKGROUND ART

Twist capsules are devices that utilize flexible circuits wrapped around a shaft to transmit signals and power across a non-continuously rotating or oscillatory interface. These devices typically permit angular rotation over some limited range. Typical examples include twist capsules that are used to carry signals and power in gimbal assembles that exhibit oscillatory motion. Various twist capsules are shown and described in U.S. Pat. Nos. 4,693,527 A and 4,710,131 A. A high-frequency ribbon cable for use in a twist capsule is shown and described in U.S. Pat. No. 6,296,725 B1. The aggregate disclosures of each of these three patents are hereby incorporated by reference.

Twist capsules are noted for very long service lives, often in excess of 100-million full-excursion cycles of up to 360 degrees. Such long service lives require careful attention to the kinematics of the capsule.

Care should be exercised to maintain low stresses within the moving conductors, which are typically flex tapes in most twist capsules. Low stresses and long service lives in twist capsule service requires the use of highly-flexible conductors and dielectric materials. The physical characteristics that are necessary for promoting longevity of the twist capsules also place serious electrical constraints upon the types of signals that can successfully transmitted thereby, particularly with respect to high-speed data transmission. The primary electrical constraints are impedance-matching and high-frequency losses. Techniques have been developed to allow the transmission of moderately high speed digital data signals through these devices, primarily by the use of multilayer flexible circuits utilizing microstrip and stripline constructions, along with design strategies that optimize circuit impedance and control electromagnetic fields by utilizing ground plane structures. These techniques become less effective with increasing frequencies, and, with data rates above 1 Gbps, are especially problematic with transmission formats that require large bandwidths and relatively high transmission line impedances.

The use of thin conductors and dielectrics minimize flex tape thickness and enhance rotational life, but place severe constraints on the impedance and losses in the resulting transmission lines. The problems are especially acute with very high speed data transmission schemes, such as LVDS, Fibre Channel, XAUI, Infiniband, and others, that are designed around copper transmission lines with relatively high characteristic or differential impedances, with 100-Ohms being a very common value.

The current state of the art in long-life twist capsule design utilizes flex tape construction with thin polyimide dielectrics to achieve flexibility. Typical thickness values that promote long life also make it practically impossible to achieve impedance values on the order of 100-Ohms without creating extremely narrow traces. For example, a 100-Ohm differential impedance in a flex tape using 3-mil polyimide dielectric requires conductor trace widths of about 2-mils or less (i.e., about 0.002" or about 0.05 mm). If this conductor width could be reliably manufactured, the circuit resistance would be extremely high, on the order of from about 5- to about 10-Ohms, or higher, for many typical twist capsules.

In addition, high-frequency losses become very important in high-speed data formats that require several gigahertz ("GHz") of bandwidth, due to fast edge speeds that contain high-frequency harmonic energy. The very narrow conductors in high-impedance flex tapes have high losses at high frequencies, due to the skin effect that confines the high-frequency carriers to a thin skin on the conductors. In addition, traditional dielectric materials, such as polyimide, exhibit high losses at frequencies above 1 GHz, and also exhibit frequency-dependent dispersion, which causes different frequencies to travel at different speeds.

The net result of using a conventional flex tape transmission line construction at data transmission rates beyond about 1.0 Gbps, is severe attenuation of the high-frequency components and smearing of the digital data edge transitions due to dispersion. An eye pattern test of such a transmission can show a severely closed eye, or no eye at all. Each of these challenges to signal integrity of high-speed data signaling will be discussed below.

Typical flexible circuit construction utilizes etched copper traces sandwiched between layers of polyimide dielectric material. The dielectric losses that are a major constraint to high-frequency performance in flexible transmission lines are illustrated in FIG. 1. The parameter of interest is the loss tangent (ordinate), a convenient measure of high-frequency loss. As FIG. 1 shows, polyimide, which is the most popular dielectric material used in flex tape construction for twist capsules, is particularly lossy at high frequencies. Other dielectric materials, such as liquid-crystal polymer ("LCP") and polytetrafluoroethylene ("PTFE"), have superior high-frequency properties, but are significantly more expensive and more difficult to manufacture. With the increased losses of high-frequency energy due to dielectric losses and skin effect, the edge speeds of high-speed data square waves can degrade to the point that data integrity may be compromised.

These dielectric materials do have the operational advantage of lower dielectric constants and lower dispersions, but high impedance transmission lines for data links of about 1.0 Gbps and beyond through flex tapes are still a very difficult challenge in the twist capsule environment. The mechanical design requirements of twist capsule and flex tape kinematics place practical constraints on the electrical design of flex tape transmission lines, and tend to favor lower impedance designs. Lower dielectric constant materials, such as PTFE and LCP, are advantageous for creating higher-impedance transmission lines, but the physical constraints required for long service life in a twist capsule are often at odds with the physical requirements of achieving high-impedance transmission lines structures, such as that required for 100-Ohm LVDS interfaces.

Accordingly, it would be generally desirable to provide an improved flex tape for use in a twist capsule that would allow the transmission of a higher bandwidth of signals.

DISCLOSURE OF THE INVENTION

With parenthetical reference to the corresponding parts, portions or surfaces of the disclosed embodiment(s), merely for purposes of illustration and not by way of limitation, the present invention broadly provides an improved twist capsule (10) that broadly includes: a flexible tape (13); and a pre-emphasis circuit (11) operatively associated with the tape to compensate for attenuation of high-frequency digital waveform constituents attributable to skin effect and/or dielectric loss; whereby the bandwidth of signal transmitted over the tape may be increased.

The pre-emphasis circuit may add additional output current during the transition time of the bit.

The pre-emphasis circuit may be placed or positioned at the input connector, the external interconnect, or may be internal to the twist capsule.

The improved flex tape may further include an equalization circuit (14) at the twist capsule signal output. This equalization circuit may act as a high-pass filter and an amplifier to the data as it exits the tape.

The improved flex tape can transfer data streams a data rates in excess of 1.0 Gbps. The tape bandwidth can be in excess of 20 GHz.

The tape may provide a controlled-impedance transmission line

The impedance of the tape may be matched to the impedance of a transmission line.

The impedance of the tape may be determined as a function of matching resistors at the ends of the tape.

Accordingly, the general object of the invention is to provide an improved flex tape for use in a twist capsule.

Another object is to provide an improved twist capsule flex tape having a pre-emphasis circuit to compensate for attenuation of high-frequency digital waveform constituents attributable to both skin effect and dielectric loss.

Another object is to provide an improved twist capsule flex tape having an equalization circuit at the twist capsule signal output to act as a high pass filter and amplifier to the data as it exits the twist capsule and enters into the receiver electronics.

Still another object is to provide high-bandwidth twist capsule flex tapes with the capability of handling multi-gigabit data speeds in excess of 3.0 Gbps, and with operational bandwidths well beyond 10.0 GHz.

These and other objects and advantages will become apparent from the foregoing and ongoing written specification, the drawings and the appended claims.

DESCRIPTION OF THE PREFERRED EMBODIMENTS

Figure 1:
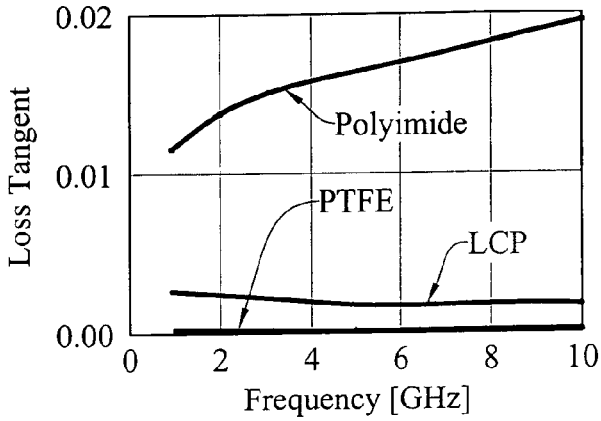
FIG. 1 is a plot of loss tangent (ordinate) vs. frequency (abscissa) for various dielectric materials.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The present invention addresses the problems of twist capsule flex tape design by the use of low-impedance transmission lines and fed with a resistive network and active electronics to provide gain, with pre-emphasis and, optionally, with equalization, to achieve much greater bandwidth than has heretofore been possible with flex tapes.

This invention extends the bandwidth of twist capsules by the use of transmit pre-emphasis, and, optionally, with a receive equalization circuit. Signal pre-emphasis circuits are used to extend the bandwidth of traditional transmission lines. This technique compensates for the attenuation to high-frequency digital waveform constituents attributable to both skin effect and dielectric loss. [See, e.g., "Using Pre-Emphasis and Equalization with Stratix GX", White Paper, Altera Corp., San Jose, Calif. (2003).]

A pre-emphasis circuit may add additional output current during the transition time of the bit. This tends to speed up the edge rate and also provides a bit of over-shoot to the signal at the driver output, with increased harmonic energy. This modified wave shape is still loaded by the interconnect (transmission line), but the end effect is now much different and improved. [See, e.g., Goldie, J., "Eye Opening Enhancements Extend the Reach of High-Speed Interfaces", National Semiconductor Corp., Silicon Valley, Calif. (2008).]

Figure 2:
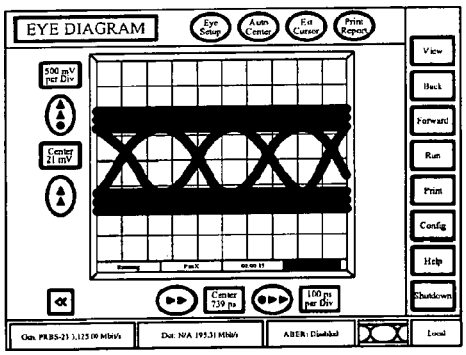
FIG. 2 is an eye diagram of the output of a twist capsule flex tape without a pre-emphasis circuit.
Figure 3:
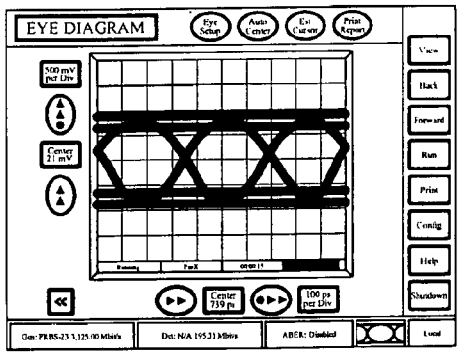
FIG. 3 is an eye diagram of the output of an improved twist capsule flex tape with a pre-emphasis circuit.

The eye patterns shown in FIGS. 2 and 3 depict and compare a twist capsule with no pre-emphasis (FIG. 2) with one using pre-emphasis (FIG. 3) at a data speed of about 3 Gbps. The eye pattern goes from unusable performance (FIG. 2) to reasonably good performance (FIG. 3). Pre-emphasis is normally performed prior to the signal entering the flexible circuit region of the twist capsule, and the pre-emphasis electronics can be placed at the input connector, in the external interconnect, or internal to the twist capsule.

Figure 4:
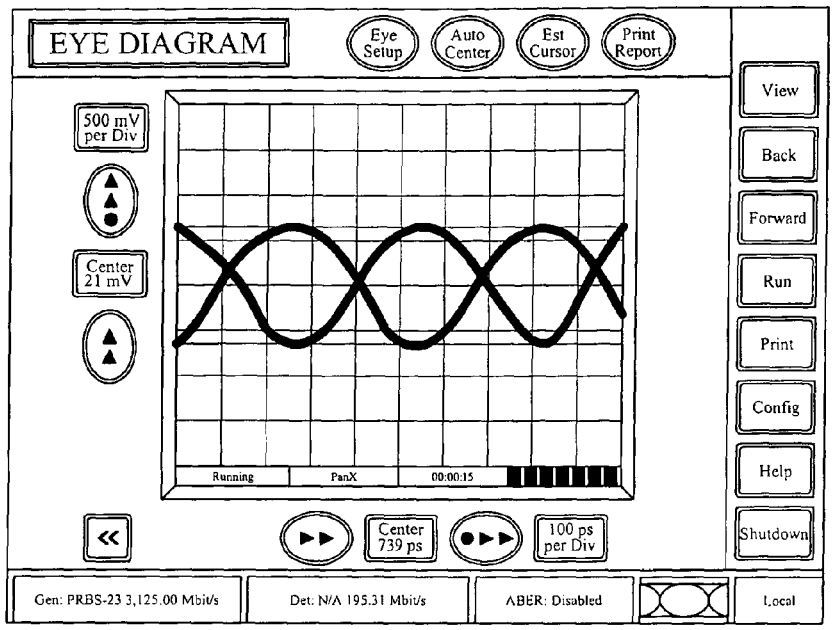
FIG. 4 is an eye diagram of an improved twist capsule flex tape with both pre-emphasis and equalization circuits.

Additional improvements to signal integrity can be accomplished with the utilization of equalization at the twist capsule signal output. Equalization acts as a high-pass filter and amplifier, compensating for frequency-dependent losses to the data as it leaves the twist capsule and prior to entering into receiver electronics. As FIG. 4 demonstrates, this signal processing produces a very open eye at about 3 Gbps through the flex tape. The equalization electronics can also be placed internal or external to the twist capsule. The combination of pre-emphasis and equalization can allow twist capsule assemblies to be utilized at data rates far beyond the current state of the art of approximately 1 Gbps or so. There is no inherent reason that these techniques cannot extend the high-frequency capabilities of twist capsules to 10 Gbps and beyond.

Referring now to the drawings, FIG. 1 is a plot of loss tangent (ordinate) vs. frequency (abscissa) for three different dielectric materials. Loss tangent is a measure of the degree to which a dielectric material converts an applied electric field into heat; i.e., a measure of loss within the dielectric medium. As shown in FIG. 1, the loss tangent of polyimide increases with frequency, whereas the loss tangent of LCP decreases slightly with increased frequency, and the loss tangent of PTFE remains substantially constant as frequency increases.

FIG. 2 is an eye diagram [i.e., voltage (ordinate) vs. time (abscissa)] of data transfer across a flexible tape at about 3 Gbps, without the use of a pre-emphasis circuit.

FIG. 3 is an eye diagram of data transfer across the flexible tape at about 3 Gbps with the use of a pre-emphasis circuit.

The twist capsule goes from unusable (FIG. 2) to reasonably good performance (FIG. 3) with the addition and use of the pre-emphasis circuit. Pre-emphasis is normally performed prior to the signal entering the flexible circuit region of the twist capsule, and the pre-emphasis electronics can be placed at the input connector, in the external interconnect, or internal to the twist capsule.

Additional improvement can be accomplished by adding an equalization circuit at the twist capsule signal output. Equalization acts as a high-pass filter and amplifier to the data as it leaves the twist capsule and prior to it entering into receiver electronics. As FIG. 4 demonstrates, this combination produces a very open eye at about 3 Gbps through the flex tape. The equalization electronics can also be placed internally or externally to the twist capsule.

Figure 5:
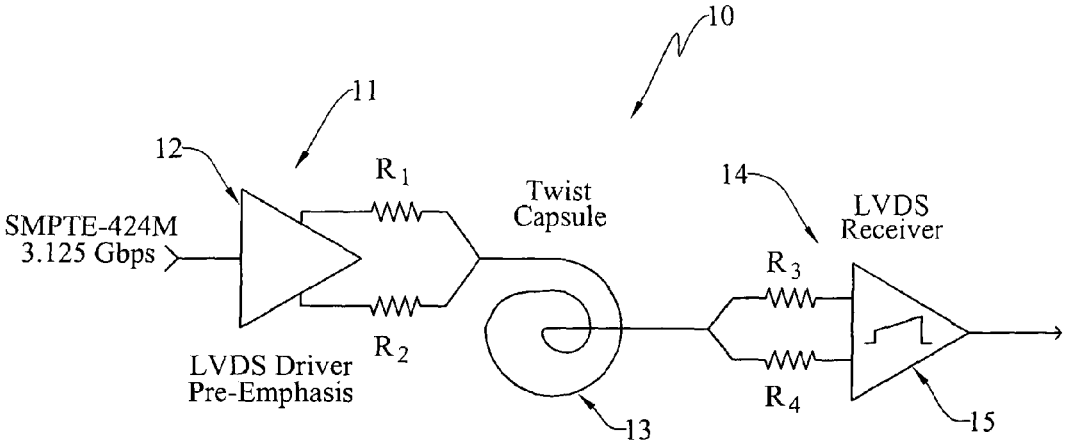
FIG. 5 is a simplified schematic showing an implementation of the invention with SMPTE 424 differentially-driven signals.

FIG. 5 is a simplified schematic of one embodiment the improved twist capsule, generally indicated at 10. In this case, differentially-driven signals at about 3.125 Gbps are provided to a pre-emphasis circuit 11 that includes an LVDS driver 12 and series termination resistors R1, R2. The output of circuit 11 is provided to the input end of flexible tape 13. At the output end of the tape, the output signal is supplied to an equalization circuit 14 that includes series termination resistors R3, R4 and an LVDS driver 15.

The addition of pre-emphasis and equalization circuits allow twist capsule assemblies to be utilized at data speeds well beyond 1 Gbps that has heretofore been seen as the practical upper limit. Indeed, signal bandwidths on the order of 20 GHz and beyond are now possible.

Various forms of such pre-emphasis and equalization circuits are commercially available.

Modifications

The present invention expressly contemplates that various changes and modifications can be made.

For example, alternative dielectric materials can be utilized for the flexible circuit design. FIG. 1 shows that both LCP and PTFE are dielectric materials that have improved high-frequency properties. These materials are useful to incrementally improve the high-frequency bandwidth of flexible circuits (over polyimide materials) and to use in conjunction with the pre-emphasis and equalization procedures explained above.

Therefore, while a preferred form of the improved broadband twist capsule has been shown and described, and several modifications thereof discussed, persons skilled in this art will readily appreciate that various additional changes and modifications can be made without departing from the spirit of the invention, as defined and differentiated by the following claims.

What is claimed is:

1. A twist capsule, comprising: a tape; and a pre-emphasis circuit operatively associated with said tape to compensate for attenuation of high-frequency digital waveform constituents attributable to skin effect and/or dielectric loss; whereby the bandwidth of signal transmitted over said tape is increased.

2. A twist capsule as set forth in claim 1 wherein said pre-emphasis circuit adds additional output current during the transition time of the bit.

3. A twist capsule as set forth in claim 1 wherein said pre-emphasis circuit is arranged in one of an input connector, an external interconnect, or is internal to the twist capsule.

4. A twist capsule as set forth in claim 1, and further comprising:

an equalization circuit at the tape output.

5. A twist capsule as set forth in claim 4 wherein said equalization circuit acts as a high pass filter and an amplifier to the data as it exits the tape.

6. A twist capsule as set forth in claim 1 wherein said tape transfers data streams at data rates in excess of 1.0 Gbps.

7. A twist capsule as set forth in claim 1 wherein the bandwidth of said tape is in excess of 10 GHz.

8. A twist capsule as set forth in claim 1 wherein said tape provides a controlled-impedance transmission line.

9. A twist capsule as set forth in claim 8 wherein the impedance of said tape is matched to the impedance of a transmission line.

10. A twist capsule as set forth in claim 9 wherein the impedance of said tape is determined as a function of matching resistors at an end of said tape.

* * * * *